US008391523B2

(12) United States Patent
Biundo Lotito et al.

(10) Patent No.: US 8,391,523 B2
(45) Date of Patent: Mar. 5, 2013

(54) METHOD AND SYSTEM FOR WIRELESS HEARING ASSISTANCE

(75) Inventors: Guiseppina Biundo Lotito, Neuchatel (CH); Evert Dijkstra, Fontaines (CH); Hans Mulder, Wunnewil (CH); Rainer Platz, Colombier (CH)

(73) Assignee: Phonak AG (CH)

( * ) Notice: Subject to any disclaimer, the term of this patent is extended or adjusted under 35 U.S.C. 154(b) by 242 days.

(21) Appl. No.: 12/738,558

(22) PCT Filed: Oct. 16, 2007

(86) PCT No.: PCT/EP2007/008969

§ 371 (c)(1),
(2), (4) Date: Jun. 28, 2010

(87) PCT Pub. No.: WO2009/049645

PCT Pub. Date: Apr. 23, 2009

(65) Prior Publication Data

US 2010/0278366 A1 Nov. 4, 2010

(51) Int. Cl.
*H04R 25/00* (2006.01)

(52) U.S. Cl. ..... 381/312; 381/314; 381/315; 381/329

(58) Field of Classification Search ..... 381/314, 381/315, 312, 326, 329, 316
See application file for complete search history.

(56) References Cited

U.S. PATENT DOCUMENTS 6,807,445 B2 * 10/2004 Baumann et al. ..... 607/57
2001/0053228 A1 12/2001 Jones
2002/0012438 A1 * 1/2002 Leysieffer et al. ..... 381/312
2002/0090098 A1 * 7/2002 Allegro et al. ..... 381/312
2002/0106094 A1 8/2002 Fujino
2004/0136522 A1 7/2004 Wurtz
2004/0247145 A1 * 12/2004 Luo et al. ..... 381/312
2006/0024608 A1 2/2006 Toyoda et al.
2006/0233406 A1 * 10/2006 Fischer ..... 381/313

(Continued)

FOREIGN PATENT DOCUMENTS

CA 2422449 A1 3/2003
DE 102005017496 B3 8/2006

(Continued)

OTHER PUBLICATIONS

International Preliminary Report on Patentability dated Apr. 20, 2010 issued in PCT/EP2007/008969.

(Continued)

*Primary Examiner* — Mohamad Musleh
*Assistant Examiner* — Mangtin Lian
(74) *Attorney, Agent, or Firm* — Conley Rose, P.C.

(57) ABSTRACT

A method for providing hearing assistance to a user, comprising capturing audio signals by an internal microphone arrangement and supplying the captured audio signals a central signal processing unit; estimating whether a certain type of external audio signal supply device is connected to the audio signal processing unit in order to supply external audio signals to the central signal processing unit, and selecting an audio signal processing scheme according to the estimated type of external audio signal supply device; processing, the captured audio signals and the external audio signals according to the selected audio signal processing scheme; transmitting the processed audio signals to stimulating means worn at or in at least one of the user's ears via a wireless audio link; and stimulating the user's hearing by said stimulating means according to the processed audio signals.

36 Claims, 3 Drawing Sheets

U.S. PATENT DOCUMENTS

| | | | | |
|---|---|---|---|---|
| 2006/0245608 | A1 | 11/2006 | Lee et al. | |
| 2006/0285706 | A1* | 12/2006 | Boor et al. | 381/190 |
| 2007/0053535 | A1* | 3/2007 | Frieding | 381/312 |
| 2007/0140512 | A1 | 6/2007 | Hain et al. | |
| 2007/0282393 | A1* | 12/2007 | Marquis | 607/55 |
| 2008/0101635 | A1* | 5/2008 | Dijkstra et al. | 381/315 |
| 2008/0192955 | A1* | 8/2008 | Merks | 381/92 |

FOREIGN PATENT DOCUMENTS

| | | | |
|---|---|---|---|
| EP | 1083769 | A1 | 3/2001 |
| EP | 1326478 | A2 | 7/2003 |
| EP | 0567535 | B1 | 8/2003 |
| EP | 1377118 | A2 | 1/2004 |
| EP | 1691574 | A2 | 8/2006 |
| EP | 1691576 | A2 | 8/2006 |
| EP | 1698908 | A2 | 9/2006 |
| EP | 1819195 | A2 | 8/2007 |
| WO | 99/09799 | | 11/1998 |
| WO | 2007/082579 | A2 | 7/2007 |
| WO | 2009/049645 | A8 | 4/2009 |

OTHER PUBLICATIONS

Search Report for European Application No. 07819037.8, May 16, 2011 (7 p.).

* cited by examiner

METHOD AND SYSTEM FOR WIRELESS HEARING ASSISTANCE

BACKGROUND OF THE INVENTION

1. Field of the Invention

The present invention relates to a system for providing hearing assistance to a user, comprising a microphone arrangement for capturing audio signals, an central signal processing unit for processing the captured audio signals, and means for transmitting the processed audio signals via a wireless audio link to means worn at or in at least one of the user's ears for stimulating the hearing of the user according to the processed audio signals.

2. Description of Related Art

Usually in such systems the wireless audio link is an FM radio link. The benefit of such systems is that sound captured by a remote microphone at the transmission unit can be presented at a high sound pressure level and good signal-to-noise ratio (SNR) to the hearing of the user wearing the receiver unit at his ear(s).

According to one typical application of such wireless audio systems, the stimulating means is a loudspeaker which is part of a receiver unit or is connected thereto. Such systems are particularly helpful for being used in teaching e.g. (a) normal-hearing children suffering from auditory processing disorders (APD), (b) children suffering a unilateral loss (one deteriorated ear), or (c) children with a mild hearing loss, wherein the teacher's voice is captured by the microphone of the transmission unit, and the corresponding audio signals are transmitted to and reproduced by the receiver unit worn by the child, so that the teacher's voice can be heard by the child at an enhanced level, in particular with respect to the background noise level prevailing in the classroom. It is well known that presentation of the teacher's voice at such enhanced level supports the child in listening to the teacher.

According to another typical application of wireless audio systems the receiver unit is connected to or integrated into a hearing instrument, such as a hearing aid. The benefit of such systems is that the microphone of the hearing instrument can be supplemented with or replaced by the remote microphone which produces audio signals which are transmitted wirelessly to the FM receiver and thus to the hearing instrument. FM systems have been standard equipment for children with hearing loss (wearing hearing aids) and deaf children (implanted with a cochlear implant) in educational settings for many years.

Hearing impaired adults are also increasingly using FM systems. They typically use a sophisticated transmitter which can (a) be pointed to the audio-source of interest (during e.g. cocktail parties), (b) put on a table (e.g. in a restaurant or a business meeting), or (c) put around the neck of a partner/speaker and receivers that are connected to or integrated into the hearing aids. Some transmitters even have an integrated Bluetooth module giving the hearing impaired adult the possibility to connect wirelessly with devices such as cell phones, laptops etc.

The merit of wireless audio systems lies in the fact that a microphone placed a few inches from the mouth of a person speaking receives speech at a much higher level than one placed several feet away. This increase in speech level corresponds to an increase in signal-to-noise ratio (SNR) due to the direct wireless connection to the listener's amplification system. The resulting improvements of signal level and SNR in the listener's ear are recognized as the primary benefits of FM radio systems, as hearing-impaired individuals are at a significant disadvantage when processing signals with a poor acoustical SNR.

CA 2 422 449 A2 relates to a communication system comprising an FM receiver for a hearing aid, wherein audio signals may be transmitted from a plurality of transmitters via an analog FM audio link.

Usually the remote wireless microphone of a wireless hearing assistance system is a portable or hand-held device which may be used in multiple environments and conditions: (a) the remote microphone may be held by the hearing-impaired person and pointed towards the desired audio source, such as in a one-to-one conversation to the interlocutor; (b) the remote microphone may be worn around the neck; (c) the remote microphone may be put on a table in a conference or restaurant situation; (d) an external microphone may be connected to the system, which may be worn, for example, in the manner of a lapel microphone or a boom microphone; (e) an external audio source, such as a music player, may be connected to the system.

Usually, the audio signal processing schemes implemented in such wireless systems are a compromise between all wearing modes and operation options. Typically, these signal processing schemes, in particular, the gain model, are fixed, apart from the user's possibility to manually choose between a few beam forming and noise canceling options, which are commonly referred to as different "zoom" positions.

For hearing instruments it is known to perform an analysis of the present acoustic environment ("classifier") based on the audio signals captured by the internal microphone of the hearing instrument in order to select the most appropriate audio signal processing scheme, in particular with regard to the compression characteristics, for the audio signal processing within the hearing instrument based on the result of the acoustic environment analysis. Examples of classifier approaches are found in US 2002/0090098 A1, US 2007/0140512 A1, EP 1 326 478 A2 and EP 1 691 576 A2.

In EP 1 691 574 A2 and EP 1 819 195 A2 wireless hearing assistance systems are described, comprising a transmission unit including a beamformer microphone arrangement and a hearing instrument, wherein a classifier for analyzing the acoustic environment is located in the transmission unit and wherein the result provided by the classifier is used to adjust the gain applied to the audio signals captured by the beam former microphone arrangement in the transmission unit and/or in the receiver unit/hearing instrument.

EP 1 083 769 A1 relates to a hearing aid system comprising a sensor for capturing the movements of the user's body, such as an acceleration sensor, wherein the information provided by such sensor is used in a speech recognition process applied to audio signals captured by the microphone of the hearing aid.

EP 0 567 535 B1 relates to a hearing aid comprising an accelerometer for capturing mechanical vibrations of the hearing aid housing in order to subtract the accelerometer signal from the audio signals captured by the internal microphone of the hearing aid.

WO 2007/082579 A2 relates to a hearing protection system comprising two earplugs, which each comprise a microphone and a loudspeaker connected by wires to a common central audio signal processing unit worn around at the user's body. A detector is provided for detecting whether external audio signals are provided to the central audio signal processing unit from an external communication device connected to the central audio signal processing unit. The output signal of the detector is used to select an audio signal processing mode of the central audio signal processing unit.

US 2004/0136522 A1 relates to a hearing protection system comprising two hearing protection headphones which both comprise an active-noise-reduction unit. The headphones also comprise a loudspeaker for reproducing external audio signals supplied from external communication devices. The system also comprises a boom microphone. A device detector is provided for controlling the supply of power to the boom microphone depending on whether a external communication device is connected to the system.

US 2002/0106094 A1 relates to a hearing aid comprising in internal and a wireless external microphone. A connection detection circuit is provided for activating the power supply of the external microphone once the external microphone is electrically separated from the hearing aid.

It is an object of the invention to provide for a method for providing hearing assistance using a wireless microphone arrangement, wherein the listening comfort, such as the signal to noise ratio (SNR), should be optimized at any time. It is a further object of the invention to provide for a corresponding wireless hearing assistance system.

SUMMARY OF THE INVENTION

According to the invention, these objects are obtained by a method as defined in claim 1 and by a system as defined in claim 19, respectively.

The invention is beneficial in that, by estimating whether a certain type of external audio signal supply device is connected to the central signal processing unit and selecting an audio signal processing scheme according to the estimated type of external audio signal supply device, the processing of the audio signals captured by the microphone arrangement can be automatically adjusted to the present use situation of the system.

Preferred embodiments of the invention are defined in the dependent claims.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
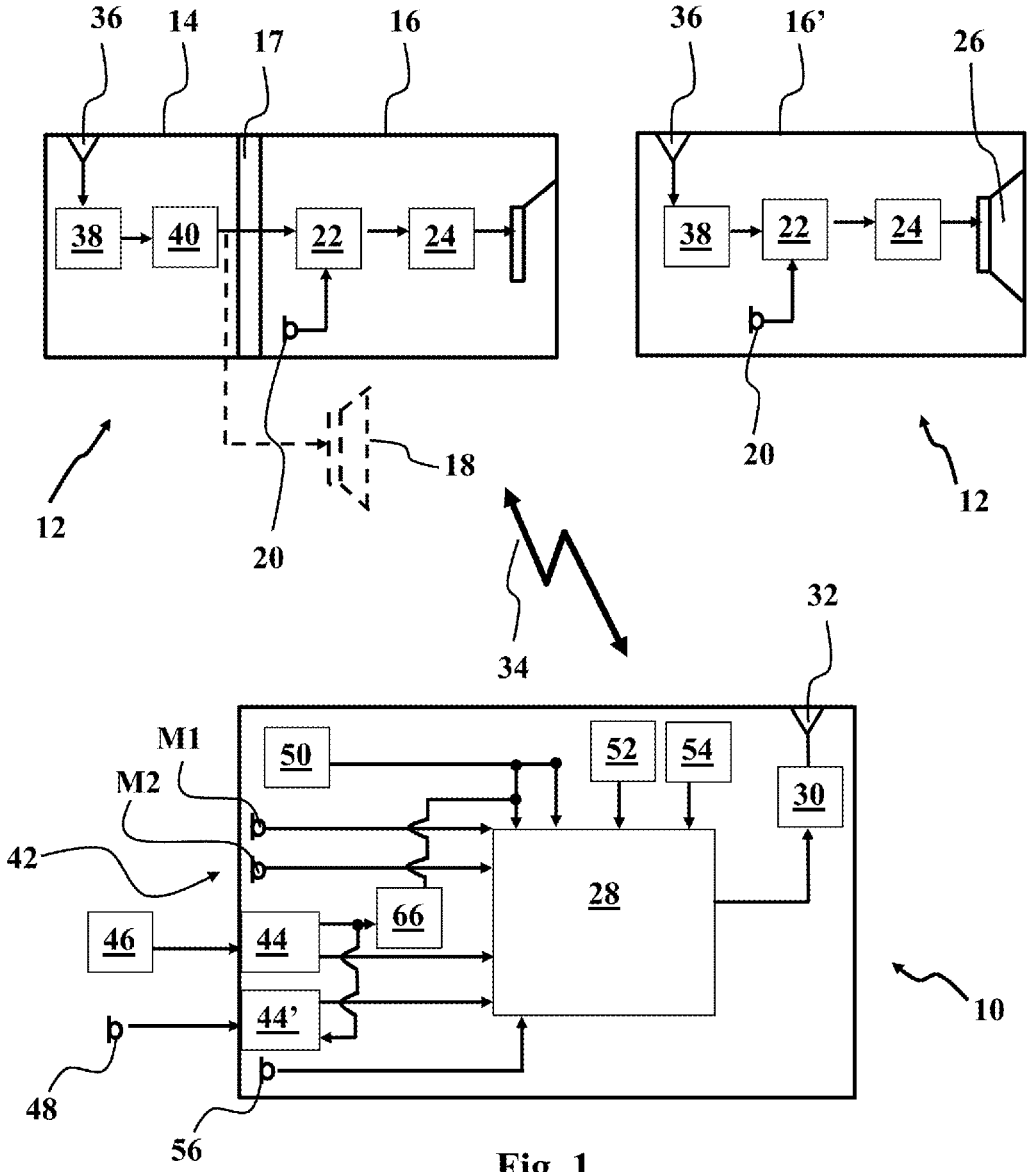
FIG. 1 is a block diagram of one embodiment of a hearing assistance system according to the invention.

FIG. 1 shows a block diagram of an example of a wireless hearing assistance system comprising a transmission unit 10 and at least one ear unit 12 which is to be worn at or in one of the user's ears (an ear unit 12 may be provided only for one of the two ears of the user, or an ear unit 12 may be provided for each of the ears). According to FIG. 1 the ear unit 12 comprises a receiver unit 14, which may supply its output signal to a hearing instrument 16 which is mechanically and electrically connected to the receiver unit 14, for example, via a standardized interface 17 (such as a so-called "audio shoe"), or, according to a variant, to a loudspeaker 18, which is worn at least in part in the user's ear canal (for example, the loudspeaker itself may be located in the ear canal or a sound tube may extend from the loudspeaker located at the ear into the ear canal).

The hearing instrument 16 usually will be a hearing aid, such as of the BTE (Behind The Ear)-type, the ITE (In The Ear)-type or the CIC (Completely In the Canal)-type. Typically, the hearing instrument 16 comprises one or more microphones 20, a central unit 22 for performing audio signal processing and for controlling the hearing instrument 16, a power amplifier 24 and a loudspeaker 26.

The transmission unit 10 comprises a transmitter 30 and an antenna 32 for transmitting audio signals processed in a central signal processing unit 28 via a wireless link 34 to the receiver unit 14, which comprises an antenna 36, a receiver 38 and a signal processing unit 40 for receiving the audio signals transmitted via the link 34 in order to supply them to the hearing instrument 16 or the speaker 18. The wireless audio link 34 preferably is an FM (frequency modulation) link.

Rather than consisting of a receiver unit 14 connected to a hearing instrument 16 the ear unit 12, as an alternative, may consist of a hearing instrument 16' into which the functionality of the receiver unit 14, i.e. the antenna 36 and the receiver 38, is integrated. Such an alternative is also schematically shown in FIG. 1.

The transmission unit 10 comprises a microphone arrangement 42, which usually comprises at least two spaced-apart microphones M1 and M2, an audio input 44 for connecting an external audio source 46, e.g. a music player, or an external microphone 48 to the transmission unit 10, a distance sensor 50, an acceleration sensor 52 and an orientation sensor 54. In addition, the transmission unit 10 may comprise a second audio input 44', so that, for example, the external audio source 46 and the external microphone 48 my be connected at the same time to the transmission unit 10. The transmission unit 10 also may comprise an auxiliary microphone 56 in close mechanical and acoustical contact with the housing of the transmission unit 10 for capturing audio signals representative of body noise and/or housing noise. The external microphone 48 may comprise one or several capsules, the signals of which are further processed in the central signal processing unit 28. The transmission unit 10 also comprises a unit 66 which is capable of determining whether and which type of an external audio signal source 46 is connected to the audio input 44 and to estimate the type of a external microphone 48, when connected to the audio input 44, by sensing at least one electrical parameter, such as the impedance of the external microphone 48.

The transmission unit 10 is designed as a portable unit which may serve several purposes: (a) it may be used in a "conference mode", in which it is placed stationary on a table; (b) it may be used in a "hand-held mode", in which it is held in the hand of the user of the ear unit 12; (c) it may be worn around a person's neck, usually a person speaking to the user of the ear unit 12, such as the teacher in a classroom teaching hearing-impaired persons, or a guide in a museum, etc. ("neck mode"); (d) it may be worn at the body of the user of the ear unit 12, with an external microphone 48 and/or an external audio source 46 being connected to the transmission unit 10 ("external audio mode"); the external audio source 46 may be e.g. a TV set or any kind of audio player (e.g. MP3). The transmission unit 10 may in this case also be placed next to the audio equipment.

Figure 2:
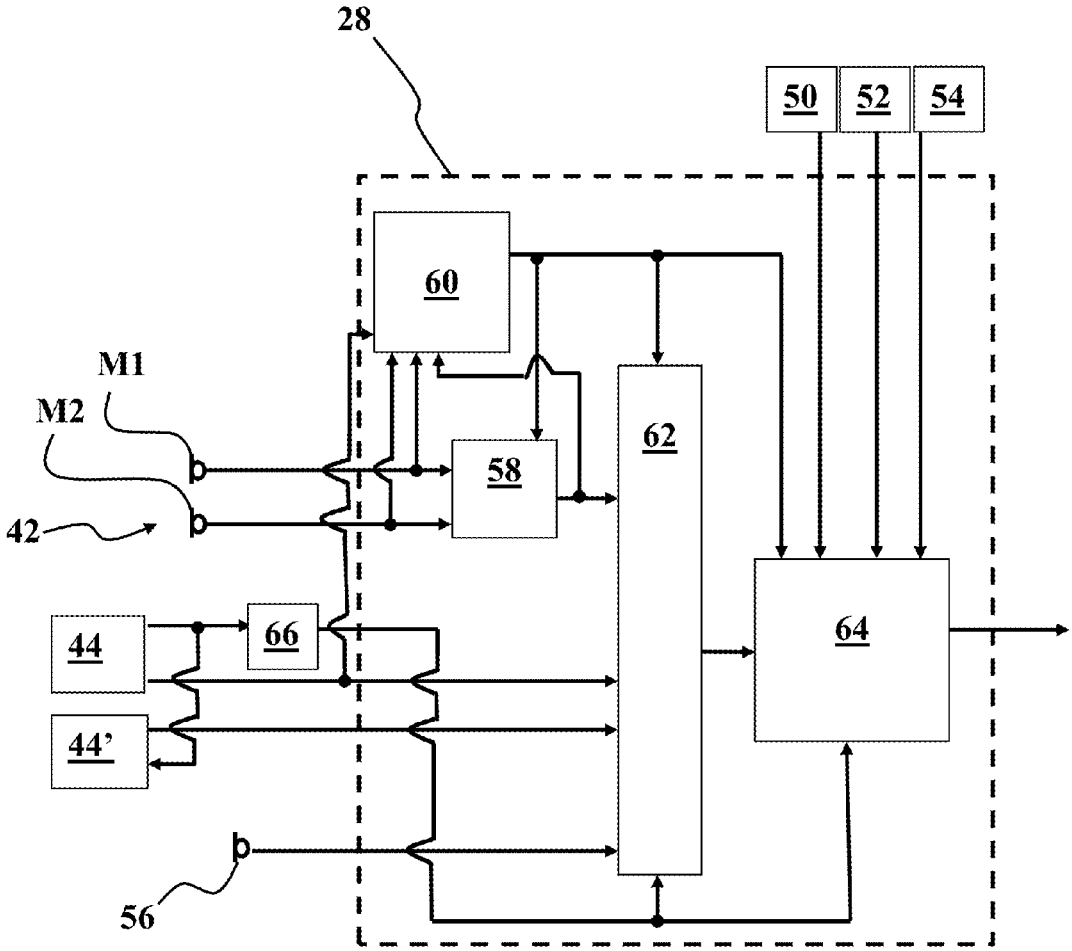
FIG. 2 is a block diagram showing in a schematic manner the internal structure of the central signal processing unit of the system of FIG. 1.

FIG. 2 is a block diagram showing in a schematic manner the internal structure of the central signal processing unit 28 of the transmission unit 10, which comprises a beam former 58, a classification unit 60 including a voice activity detector (VAD), an audio signal mixing/adding unit 62 and an audio signal processing unit 64. The audio signal processing unit 64 usually will include elements like a gain model, noise canceling algorithms and/or an equalizer, i.e. frequency-dependent gain control.

The audio signals captured by the microphones M1, M2 of the microphone arrangement 42 are supplied as input to the beam former 58, and the output signal provided by the beam former 58 is supplied to the mixing/adding unit 62. In addition, the audio signals of at least one of the microphones M1, M2 are supplied to the classification unit 60; in addition, also the output of the beam former 58 may be supplied to the classification unit 60. The classification unit 60 serves to analyze the audio signals captured by the microphone arrangement 42 in order to determine a present auditory scene category from a plurality of auditory scene categories, i.e. the classification unit 60 serves to determine the present acoustic environment. The output of the classification unit 60 is supplied to the beam former 58, the mixing/adding unit 62 and the audio signal processing unit 64 in order to control the audio signal processing in the central signal processing unit 28 by selecting the presently applied audio signal processing scheme according to the present acoustic environment as determined by the classification unit 60.

Also the audio signals captured by the external microphone 48 may be supplied to the classification unit 60 in order to be taken into account in the auditory scene analysis.

The output of the audio input monitoring unit 66 may be supplied to the classification unit 60, to the mixing/adding unit 62 and to the audio signal processing unit 64 in order to select an audio signal processing scheme according to the presence of an external audio source 46 or according to the type of external microphone 48. For example, the external microphone 48 may be a boom microphone, one or a plurality of omni-directional microphones or a beam-forming microphone. Depending on the type of microphone, the audio input sensitivity and other parameters, such as the choice between an energy-based VAD or a more sophisticated VAD based on direction of arrival in the classification unit 60, may be adjusted automatically.

The audio signals captured by the auxiliary microphone 56 are supplied to the mixing/adding unit 62 in order to be subtracted from the audio signals captured by the microphone arrangement 42, for example, by using a Wiener filter, in order to remove body noise and/or housing noise from the audio signals captured by the microphone arrangement 42.

The audio signals received at the audio input 44, 44' are supplied to the mixing/adding unit 62.

The output of the mixing/adding unit 62 is supplied to the audio signal processing unit 64.

The distance sensor 50 may comprise an acoustic, usually ultrasonic, and/or an optical, usually infrared, distance sensor in order to measure the distance between the sound source, usually a speaking person towards which the microphone arrangement 42 is directed, and the microphone arrangement 42. To this end, the distance sensor 50 is arranged in such a manner that it aims at the object to which the microphone arrangement 42 is directed. The output of the distance sensor 50 is taken into account in the audio signal processing unit 64 in order to select an audio signal processing scheme according to the measured distance.

The acceleration sensor 52 serves to measure the acceleration acting on the transmission unit 10—and hence on the microphone arrangement 42—in order to estimate in which mode the transmission unit 10 is presently used. For example, if the measured acceleration is very low, it can be concluded that the transmission unit 10 is used in a stationary mode, i.e. in a conference mode.

The orientation sensor 54 preferably is designed for measuring the spatial orientation of the transmission unit, and hence the microphone arrangement 42, so that it can be estimated whether the microphone arrangement 42 oriented essentially vertical or essentially horizontal. Such orientation information can be used for estimating the present use mode of the transmission unit 10. For example, an essentially vertical orientation is typical for a neck-worn/chest-worn mode.

By combining the information provided by the acceleration sensor 52 and the orientation sensor 54 the best estimation of the present use mode is obtained. For example, an essentially horizontal position without significant acceleration is an indicator of a conference/restaurant mode, whereas an essentially horizontal position with acceleration of some extent is an indicator of a hand-held mode. In the hand-held mode, the distance measurement by the distance sensor 50 is most useful, since in the hand-held mode the user may hold the transmission unit 10 in such a manner that the microphone arrangement 52 points to a person speaking to the user. The orientation sensor 54 may comprise a gyroscope, a tilt sensor and/or a roll ball switch.

The output of the sensors 50, 52 and 54 is supplied to the audio signal processing unit 64 in order to select an audio signal processing scheme according to the measured values of the mechanical parameters of the microphone arrangement 42 monitored by the sensors 50, 52 and 54. In particular, as already mentioned above, the information provided by the sensors 50, 52 and 54 can be used to estimate the present use mode of the transmission unit 10 in order to automatically optimize the audio signal processing by selecting the audio signal processing scheme most appropriate for the present use mode.

In the following, examples of such optimization of the audio signal processing are described by reference to FIGS. 3 to 5.

At the bottom in FIG. 3 an example of the gain as a function of the input signal level (the corresponding dependency of the output signal level on the input signal level is shown above in FIG. 3) of a default gain model is shown. In the example of FIG. 3 the gain is essentially constant for medium input signal levels (from K1 to K2) while the gain is reduced for high input signal levels with increasing input signal level ("compression") and the gain is also reduced for low input signal levels ("soft squelch" or "expansion").

Figure 5:
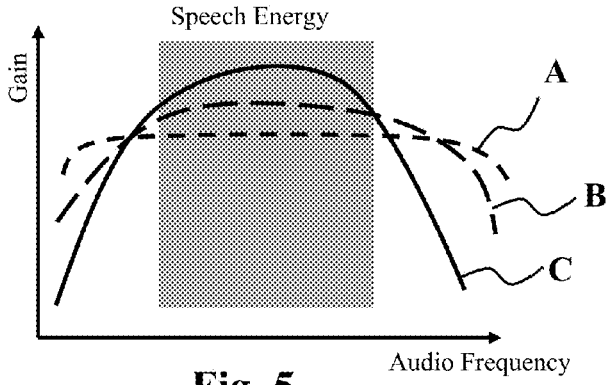
FIG. 5 shows an example of the gain as a function of the audio signal frequency for a default setting and for specific use modes of a hearing assistance system according to the invention.

FIG. 5 shows an example of the gain as a function of frequency of a default gain model (curve A), which is relatively flat.

Figure 3:
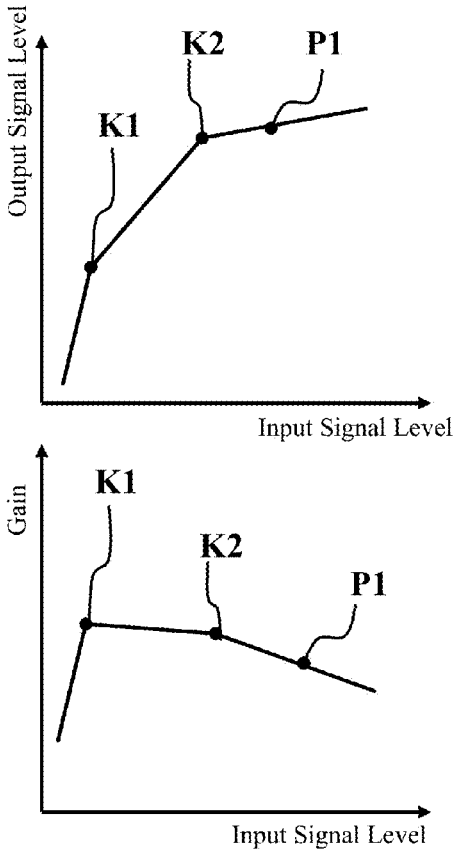
FIG. 3 is an example of a default setting of the output signal level (top) and the corresponding gain (bottom) as a function of the input signal level.
Figure 4:
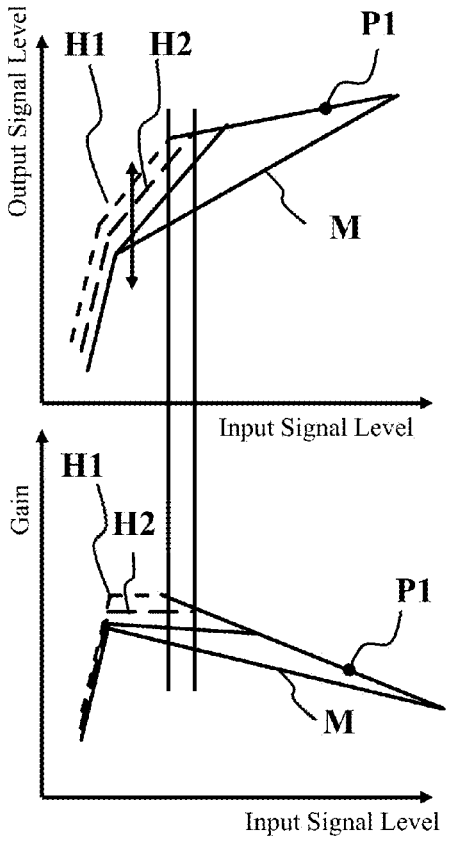
FIG. 4 shows examples of deviations from the default setting of FIG. 3 for different use modes of a hearing assistance system according to the invention.

When the transmission unit 10 is hanging around the neck or is attached to the chest of a person speaking to the user of the ear unit 12 ("neck/chest mode", which is indicated by an essentially vertical position as measured by the orientation sensor 54), input levels exceeding 75 dB-SPL can typically be expected for the speech signal to be transmitted (this condition is indicated by the working point P1 in FIGS. 3 and 4). The compression reduces the gain in this case. In the "neck/chest mode", input signals below a certain level, e.g. knee point K2, can be considered to be mostly surrounding noise and/or clothing noise and shall be compressed. Based on the information of the wearing mode, the release time of the compression algorithm can be increased to a few seconds, which avoids the background noise coming up in speech pauses.

A similar reduction of the overall gain may take place if the audio input monitoring unit 66 detects that a chest microphone or a boom microphone is connected to the transmission unit 10.

When the audio input monitoring unit 66 detects the presence of an external audio signal source 46, which typically is a music player, a "music mode" may be selected in which the dynamic range is increased, for example, by avoiding too strong compression in order to enhance the listening comfort (an example is indicated in FIG. 4 by the curve M).

When the transmission unit 10 is in a horizontal position with virtually no movement, which is an indicator for the conference/restaurant mode in which the transmission unit 10 is placed on a table, the beam former 58 should be switched to an omni-directional mode in which there is no beam forming, while the frequency-dependent gain should be optimized for speech understanding. According to FIG. 5, speech understanding may be enhanced by reducing the gain at frequencies below and above the speech frequency range, see curve C. Alternatively, the beam former 58 may be switched to a zoom mode in which the direction of the beamformer is automatically adjusted to the direction of the most intense sound source.

As already mentioned above, an essentially horizontal position of the transmission unit 10 with relative movements of some extent indicates that the transmission unit 10 is carried in the hand of the user of the ear unit 12. In this case, a beamforming algorithm with enhanced gain at lower input levels (as indicated by the arrow in FIG. 4) would be the first choice. The gain applied at lower input levels may depend on the measured distance to the sound source, with a larger distance requiring higher gain. Such enhanced gain at lower input levels is indicated by the curves H1 and H2 in FIG. 4. In addition, an enhanced roll-off at low and high frequencies, i.e. at frequencies outside the speech frequency range, may be applied in order to emphasize speech signals while keeping low frequency and high frequency noises at reduced gain levels, see curves B and C of FIG. 5.

The information obtained by the distance sensor 50 with regard to the distance of the microphone arrangement 42 to the sound source may be used to set the level-dependent and/or frequency-dependent gain and/or the aperture angle of the beam former 58 according to the measured distance.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method for providing hearing assistance to a user, comprising:

capturing audio signals by an internal microphone arrangement and supplying the captured audio signals to a central signal processing unit;

estimating whether external microphone is connected to the central signal processing unit in order to supply external audio signals to the central signal processing unit and estimating the type of external microphone by sensing at least one electrical parameter of the external microphone, and selecting an audio signal processing scheme according to the estimated type of external microphone;

processing, by said central signal processing unit, the captured audio signals and the external audio signals according to the selected audio signal processing scheme;

transmitting the processed audio signals to stimulating means worn at or in at least one of the user's ears via a wireless audio link; and stimulating the user's hearing by said stimulating means according to the processed audio signals.

2. The method of claim 1, wherein the wireless audio link is an FM link.

3. The method of claim 1, wherein the external audio signal supply device is an external audio source.

4. The method of claim 3, wherein an audio signal processing scheme according to a music mode is selected wherein a dynamic range is increased with regard to a default audio signal processing scheme.

5. The method of claim 1, wherein the external audio signal supply device is a an external microphone, wherein a type of external microphone is estimated by sensing at least one electrical parameter of the external microphone, and wherein the audio signal processing scheme is selected according to the estimated type of external microphone.

6. The method of claim 5, wherein an audio signal processing scheme is selected in which an audio input sensitivity is adjusted according to the estimated type of external microphone.

7. The method of claim 5, wherein an audio signal processing scheme is selected in which a type of voice activity detector is selected according to the estimated type of external microphone.

8. The method of claim 1, further comprising analyzing, by a classification unit of the central signal processing unit, the audio signals in order to determine a present auditory scene category from a plurality of auditory scene categories, and selecting an audio signal processing scheme according to the determined present auditory scene category.

9. The method of claim 1, comprising: measuring at least one mechanical parameter selected from the group consisting of an acceleration of the internal microphone arrangement, a spatial orientation of the internal microphone arrangement and a distance of the internal microphone arrangement to a sound source; and selecting an audio signal processing scheme according to the measured at least one mechanical parameter.

10. The method of claim 9, wherein the internal microphone arrangement comprises at least two spaced-apart microphones capable of acoustic beamforming.

11. The method of claim 10, wherein, if an essentially stationary horizontal orientation of the internal microphone arrangement is measured, an audio signal processing scheme corresponding to a conference mode is selected in which, with regard to a default audio signal processing scheme, a frequency-dependent gain is optimized for speech understanding.

12. The method of claim 11, wherein an audio signal processing scheme is selected in which there is no beamforming.

13. The method of claim 11, wherein an audio signal processing scheme including an acoustic zoom mode is selected in which a direction of the beamformer is automatically adjusted to a direction of the most intense sound source.

14. The method of claim 10, wherein, if an essentially horizontal non-stationary orientation of the microphone arrangement is measured, an audio signal processing scheme according to a hand-held mode is selected in which beamforming takes place and wherein, with regard to a default audio signal processing scheme, a gain at low input levels is enhanced.

15. The method of claim 14, wherein the enhancement of the gain at low input levels increases with increasing measured distance of the microphone arrangement to the sound source.

16. The method of claim 15, wherein an audio signal processing scheme is selected in which, with regard to a default audio signal processing scheme, a gain at frequencies below and above a speech frequency range is reduced in order to emphasize speech signals.

17. The method of claim 10, wherein, if an essentially vertical orientation of the microphone arrangement is measured, an audio signal processing scheme according to a neck/chest mode is selected in which, with regard to a default audio signal processing scheme, at least one of an overall gain is reduced and the release time is increased to more than one second in order to reduce background noise.

18. The method of claim 10, wherein an audio signal processing scheme is selected wherein at least one of a gain, which is at least one of level-dependent and frequency-dependent, and an aperture angle of the beamformer is selected according to a measured distance of the microphone arrangement to the sound source.

19. A system for providing hearing assistance to a user, comprising:

a internal microphone arrangement for capturing audio signals;

means for estimating whether an external microphone is connected to a central signal processing unit and for estimating the type of external microphone by sensing at least one electrical parameter of the external microphone, wherein the central signal processing unit is for processing the captured audio signals and the external audio signals supplied by the external microphone according to an audio signal processing scheme selected according to the estimated type of external microphone; and means for transmitting the processed audio signals via a wireless audio link to means worn at or in at least one of the user's ears for stimulating a hearing of the user according to the processed audio signals, said transmitting means comprising a transmitter portion and a receiver portion.

20. The system of claim 19, wherein the transmitting means is adapted to establish a radio frequency audio link.

21. The system of claim 19, wherein the internal microphone arrangement, the estimating means, the central signal processing unit and the transmitter portion are integrated within a portable unit.

22. The system of claim 21, wherein the portable unit is a hand-held unit.

23. The system of claim 21, wherein the portable unit is adapted to be worn around a person's neck/on a person's chest.

24. The system of claim 21, wherein the external audio signal supply device is an external audio signal source, and wherein the portable unit comprises an input for supplying audio signals from an external audio signal source to the audio signal processing unit.

25. The system of claim 21, wherein the external audio signal supply device is an external microphone, and wherein the portable unit comprises an input for supplying audio signals captured by the external microphone to the audio signal processing unit.

26. The system of claim 25, wherein the estimating means is for estimating a type of external microphone connected to the input by sensing at least one electrical parameter of the external microphone, and wherein the central signal processing unit is adapted to select an audio signal processing scheme according to the estimated type of external microphone.

27. The system of claim 21, wherein the portable unit comprises means for measuring at least one mechanical parameter selected from the group consisting of an acceleration of the internal microphone arrangement, a spatial orientation of the internal microphone arrangement and a distance of the internal microphone arrangement to a sound source, and wherein the central signal processing unit is for processing the captured audio signals according to an audio signal processing scheme selected according to the measured at least one mechanical parameter.

28. The system of claim 27, wherein the measuring means comprises at least one of an acoustic distance sensor and an optical distance sensor.

29. The system of claim 27, wherein the measuring means comprises at least one of a gyroscope, a tilt sensor and a roll ball switch.

30. The system of claim 27, wherein the measuring means are for measuring the spatial orientation of the microphone arrangement within a vertical plane.

31. The system of claim 19, wherein the central signal processing unit comprises a classification unit for analyzing the audio signals in order to determine a present auditory scene category from a plurality of auditory scene categories, and wherein the central signal processing unit is adapted to select an audio signal processing scheme according to the determined present auditory scene category.

32. The system of claim 31, wherein the classification unit comprises a voice activity detector.

33. The system of claim 19, wherein the stimulating means is part of a hearing instrument comprising at least one microphone.

34. The system of claim 33, wherein the receiver portion is integrated within or connected to the hearing instrument.

35. The system of claim 21, wherein the portable unit comprises an auxiliary microphone in close mechanical and acoustical contact with the housing of the portable unit for capturing audio signals representative of at least one of body noise and housing noise, and wherein the audio signal processing unit is adapted to use the audio signals captured by the auxiliary microphone for removing at least one of body noise and housing noise from the audio signals captured by the microphone arrangement.

36. The system of claim 35, wherein the audio signal processing unit is adapted to use a Wiener filter in order to subtract the audio signals captured by the auxiliary microphone from the audio signals captured by the microphone arrangement.

* * * * *

UNITED STATES PATENT AND TRADEMARK OFFICE

CERTIFICATE OF CORRECTION

PATENT NO. : 8,391,523 B2
APPLICATION NO. : 12/738558
DATED : March 5, 2013
INVENTOR(S) : Biundo Lotito et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 315 days.

Signed and Sealed this
First Day of September, 2015

Michelle K. Lee

Michelle K. Lee
*Director of the United States Patent and Trademark Office*